US009849321B2

(12) United States Patent
Huotari et al.

(10) Patent No.: US 9,849,321 B2
(45) Date of Patent: Dec. 26, 2017

(54) CONCEALED SPRINKLER ACTIVATION

(71) Applicants: MARIOFF CORPORATION OY, Vantaa (FI); Bryan Robert Siewert, Jupiter, FL (US)

(72) Inventors: Arto Huotari, Helsinki (FI); Bryan Robert Siewert, North Palm Beach, FL (US); Timothy Galante, West Hartford, CT (US); Michael Kenneth Krager, Whitinsville, MA (US); Enrico Manes, Feeding Hills, MA (US); Brian J. Stumm, Helsinki (FI)

(73) Assignee: MARIOFF CORPORATION OY, Vantaa (FI)

( * ) Notice: Subject to any disclaimer, the term of this patent is extended or adjusted under 35 U.S.C. 154(b) by 100 days.

(21) Appl. No.: 14/443,885

(22) PCT Filed: Sep. 24, 2013

(86) PCT No.: PCT/US2013/061408

§ 371 (c)(1),
(2) Date: May 19, 2015

(87) PCT Pub. No.: WO2014/084954

PCT Pub. Date: Jun. 5, 2014

(65) Prior Publication Data

US 2015/0297929 A1 Oct. 22, 2015

Related U.S. Application Data

(60) Provisional application No. 61/731,007, filed on Nov. 29, 2012.

(51) Int. Cl.
*A62C 37/08* (2006.01)
*A62C 37/12* (2006.01)
(Continued)

(52) U.S. Cl.
CPC ..... *A62C 37/12* (2013.01); *A62C 31/02* (2013.01); *A62C 31/28* (2013.01); *A62C 35/58* (2013.01);
(Continued)

(58) Field of Classification Search
CPC ..... A62C 37/12; A62C 31/02; A62C 35/58; A62C 31/28; A62C 37/14; A62C 35/68; B05B 15/06; B05B 15/00; B05B 1/28
(Continued)

(56) References Cited

U.S. PATENT DOCUMENTS 1,667,425 A 4/1928 Loepsinger
3,393,746 A * 7/1968 Hodnett ..... A62C 37/12 169/41
(Continued)

FOREIGN PATENT DOCUMENTS

CN 101014388 A 8/2007
CN 101549196 A 10/2009
DE 102008021493 A1 11/2009

OTHER PUBLICATIONS

Notification of Transmittal of the International Search Report and the Written Opinion of the International Searching Authority, or the Declaration for PCT/US2013/061408, Issued Jul. 30, 2014, dated Oct. 30, 2014, 13 pages.
(Continued)

*Primary Examiner* — Steven J Ganey
(74) *Attorney, Agent, or Firm* — Cantor Colburn LLP

(57) ABSTRACT

A fire suppression sprinkler assembly coupled to a mounting surface includes a sprinkler having a heat responsive element arranged adjacent a first end. A cover plate is positioned adjacent the heat responsive element and includes a thermally conductive cover layer. A reflective shield has a reflective interior surface. The reflective shield is positioned
(Continued)

substantially opposite the cover plate adjacent the first end of the sprinkler such that heat reflects from the top plate towards the heat responsive element.

35 Claims, 7 Drawing Sheets

(51) Int. Cl.

| | |
|---|---|
| ***A62C 35/58*** | (2006.01) |
| ***A62C 31/28*** | (2006.01) |
| ***A62C 31/02*** | (2006.01) |
| ***B05B 15/06*** | (2006.01) |
| ***B05B 1/28*** | (2006.01) |
| ***B05B 15/00*** | (2006.01) |
| ***A62C 37/14*** | (2006.01) |
| ***A62C 35/68*** | (2006.01) |

(52) U.S. Cl.
CPC ..... *A62C 35/68* (2013.01); *A62C 37/14* (2013.01); *B05B 1/28* (2013.01); *B05B 15/00* (2013.01); *B05B 15/06* (2013.01)

(58) Field of Classification Search
USPC ..... 169/37, 16, 41; 239/200, 208, 209, 239/288–288.5
See application file for complete search history.

(56) References Cited

U.S. PATENT DOCUMENTS

| | | | | |
|---|---|---|---|---|
| 3,727,695 | A * | 4/1973 | Danton | A62C 37/08 169/37 |
| 3,998,273 | A | 12/1976 | Juliano | |
| 4,105,076 | A | 8/1978 | Simons et al. | |
| 4,706,759 | A | 11/1987 | Grasseschi | |
| 4,715,447 | A | 12/1987 | Johnson | |
| 4,977,963 | A | 12/1990 | Simons | |
| 5,020,601 | A | 6/1991 | Retzloff et al. | |
| 5,072,792 | A | 12/1991 | Simons et al. | |
| 5,080,176 | A | 1/1992 | Polan et al. | |
| 5,083,616 | A | 1/1992 | Polan | |
| 5,372,203 | A | 12/1994 | Galaszewski | |
| 6,082,463 | A | 7/2000 | Ponte | |
| 6,805,203 | B2 | 10/2004 | Retzloff et al. | |
| 6,840,329 | B2 | 1/2005 | Kikuchi et al. | |
| 7,543,654 | B2 | 6/2009 | Koiwa | |
| 8,002,046 | B2 * | 8/2011 | Neeb | A62C 37/10 169/37 |
| 2007/0215720 | A1 | 9/2007 | Kiowa | |

OTHER PUBLICATIONS

Chinese Office Action; CN Application No. 201380062556.7; CN OA Issued Apr. 5, 2017, pp. 1-14.

* cited by examiner

CONCEALED SPRINKLER ACTIVATION

BACKGROUND OF THE INVENTION

The invention relates generally to a fire suppression systems and, more particularly, to a concealed fire suppression sprinkler having a more efficient activation.

Fire suppression systems typically include sprinklers positioned strategically within an area where fire protection is desired. The sprinklers remain inactive most of the time. Even though the sprinklers are inactive, many systems include fire suppression fluid within the conduits that supply the sprinklers. The fluid is pressurized and it is necessary to maintain an adequate seal to prevent any leaks at the sprinklers while they are inactive.

In some instances, the sprinklers in a fire suppression system may be concealed. Concealed sprinklers are usually covered by a cover plate which is substantially flush with a ceiling in which the sprinkler is mounted. The cover plate is soldered in place such that in the presence of a fire, heat and combustion gasses flow through a small gap between the cover plate and the ceiling. The high temperature melts the solder causing the cover plate to separate from the sprinkler and expose the activator bulb. Because the activator bulb is initially concealed by the cover plate, the flow of combustion gasses to the activator bulb is restricted until the cover plate is removed, thereby delaying the activation of the sprinkler.

BRIEF DESCRIPTION OF THE INVENTION

According to one embodiment of the invention, a fire suppression sprinkler assembly coupled to a mounting surface includes a sprinkler having a heat responsive element arranged adjacent a first end. A cover plate is positioned adjacent the heat responsive element and includes a thermally conductive cover layer. A reflective shield has a reflective interior surface. The reflective shield is positioned substantially opposite the cover plate adjacent the first end of the sprinkler such that heat reflects from the top plate towards the heat responsive element.

According to another aspect of the invention, a method of activating a fire suppression sprinkler is provided including heating a cover layer coupled to a cover plate located adjacent a first end of the sprinkler. Heat from the cover layer is then transmitted to a top plate positioned opposite the cover plate. Heat reflects from the top plate toward a heat responsive element positioned adjacent the first end of the sprinkler such that the heat responsive element activates the sprinkler According to yet another aspect of the invention, a fire suppression sprinkler assembly coupled to a mounting surface is provided including a sprinkler having a heat responsive element arranged adjacent a first end. A cover plate is positioned adjacent the heat responsive element. The cover plate includes a plurality of holes through which heat and gas reach the heat responsive element such that the cover plate is thermally semi-transparent.

According to yet another aspect of the invention, a method of activating a fire suppression sprinkler is provided including heating a thermally semi-transparent cover plate. Heat from the cover plate is transmitted to the air formed within a cavity of the cover plate. The heated air within the cavity is channeled to a heat responsive element located at a first end of the sprinkler such that the heat responsive element activates the sprinkler.

According to another aspect of the invention, a fire suppression sprinkler assembly coupled to a mounting surface is provided including a sprinkler having a heat responsive element arranged adjacent a first end. A cover plate including a plurality of openings is positioned adjacent the heat responsive element such that the cover plate surrounds a portion of the heat responsive element. A top plate is positioned generally opposite the cover plate to substantially enclose the heat responsive element. At least one of the cover plate and top plate is configured to direct heat toward the heat responsive element.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION OF THE INVENTION

Figure 1:
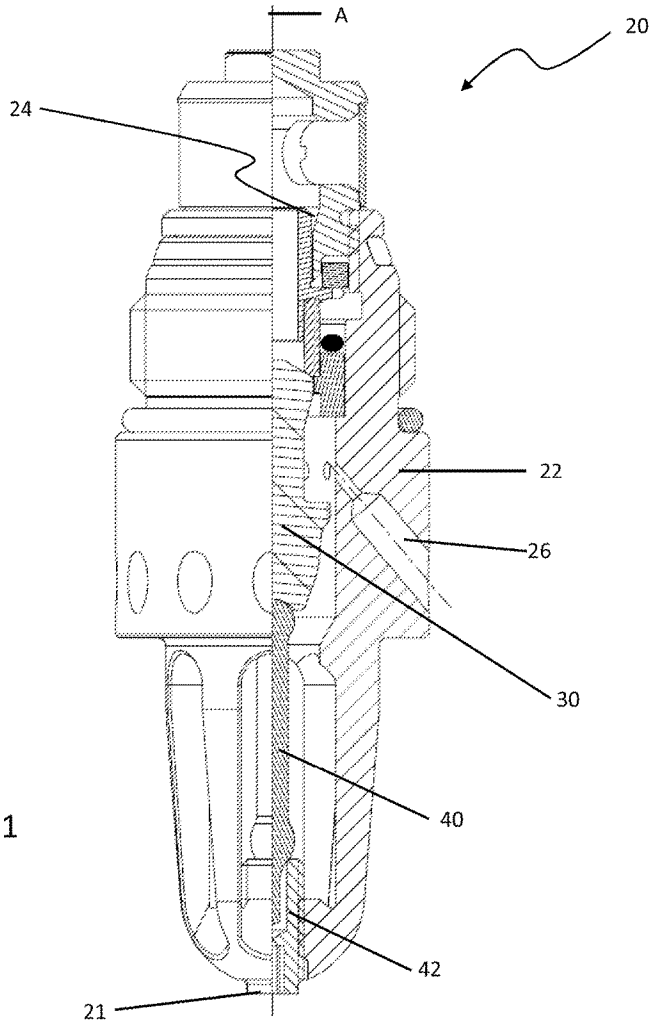
FIG. 1 is a cross-section of an exemplary portion of a fire suppression sprinkler assembly.
Figure 2:
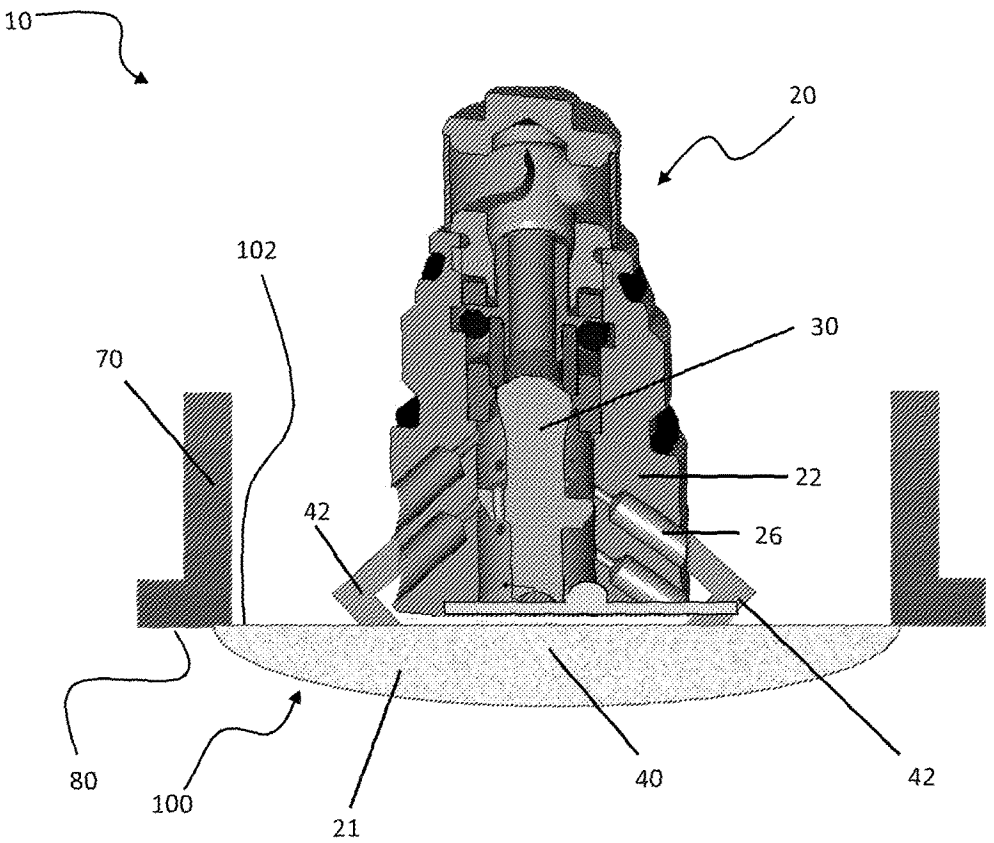
FIG. 2 is a cross-section of a fire suppression sprinkler assembly according to an embodiment of the invention.

Referring now to FIG. 1, a portion of a fire suppression sprinkler assembly 10 is illustrated. The fire suppression sprinkler assembly 10 includes a fire suppression sprinkler 20 configured to discharge a mist of fire suppression fluid, such as water for example. The sprinkler 20 includes a housing 22 that establishes a flow path 24 through at least a portion of the housing 22. For example, the sprinkler housing 22 may include a plurality of channels 26 extending from the center of the sprinkler 20 outwards, such that the fire suppression fluid will be discharged through these channels 26 to outside the sprinkler 20. Disposed within the center of the sprinkler 20 is a water seat 30 movable between an inactive and an active position. When the water seat 30, and therefore the sprinkler 20, is in an inactive state, the water seat 30 is configured to close off the flow path 24. An activator bulb or other heat responsive element 40, disposed vertically between the water seat 30 and an adjustment member 42 located at a first end 21 of the sprinkler 20, retains the water seat 30 in an inactive position. The activator bulb 40 operates in a known manner for maintaining the sprinkler 20 in an inactive condition under most circumstances. When experiencing an elevated temperature, such as in the presence of a fire for example, a fluid within the activator bulb 40 expands, causing the bulb to break, and thereby allowing the sprinkler 20 to transition to an active, operating state in a known manner. The fire suppression sprinkler assembly 10 may include other types of fire suppression sprinklers, for example sprinklers 20 having an activator bulb 40 in a horizontal configuration. An exemplary horizontal activator bulb 40 is illustrated in FIG. 2. Though the illustrated sprinkler 20 is a compressive activator bulb 40, alternate configurations, such as a tensile activator bulb for example, are within the scope of the invention. Fire suppression sprinklers 20 having an activator bulb 40 arranged in a horizontal configuration function in substantially the same manner as the fire suppression sprinklers 20 having a vertically oriented activator bulb 40 as described above.

Figure 3:
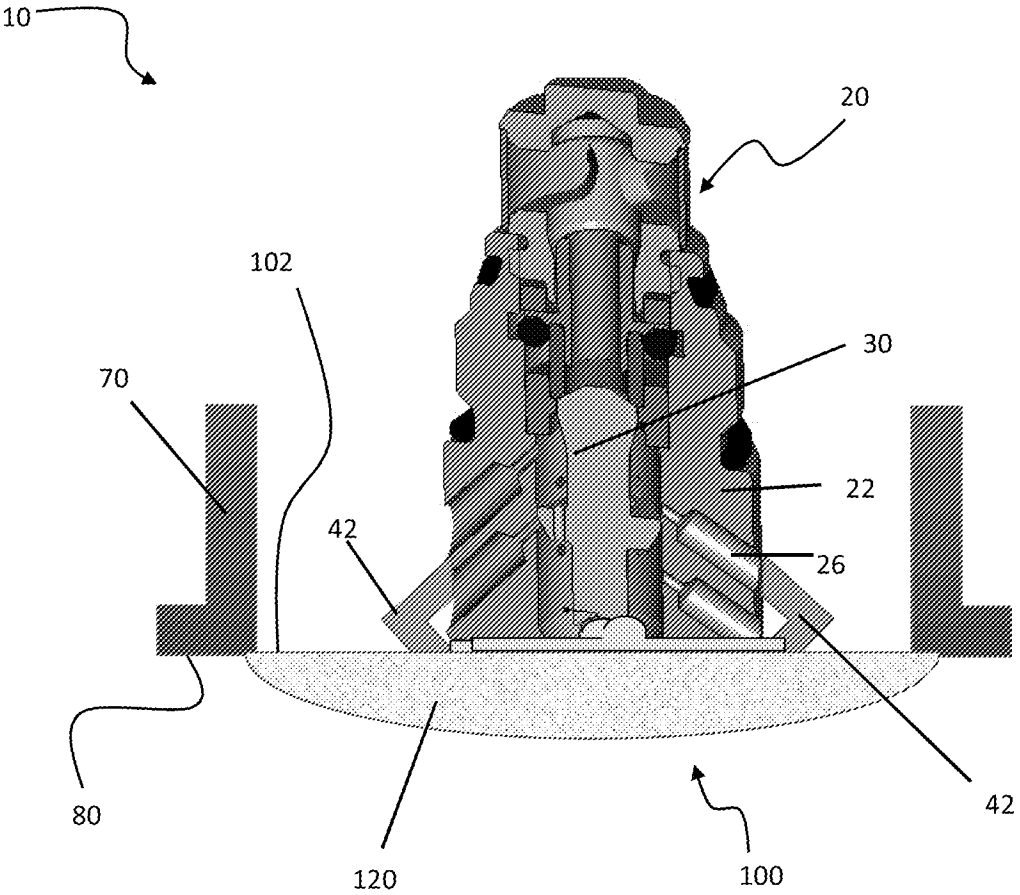
FIG. 3 is a cross-section of a fire suppression sprinkler assembly according to an embodiment of the invention.
Figure 4:
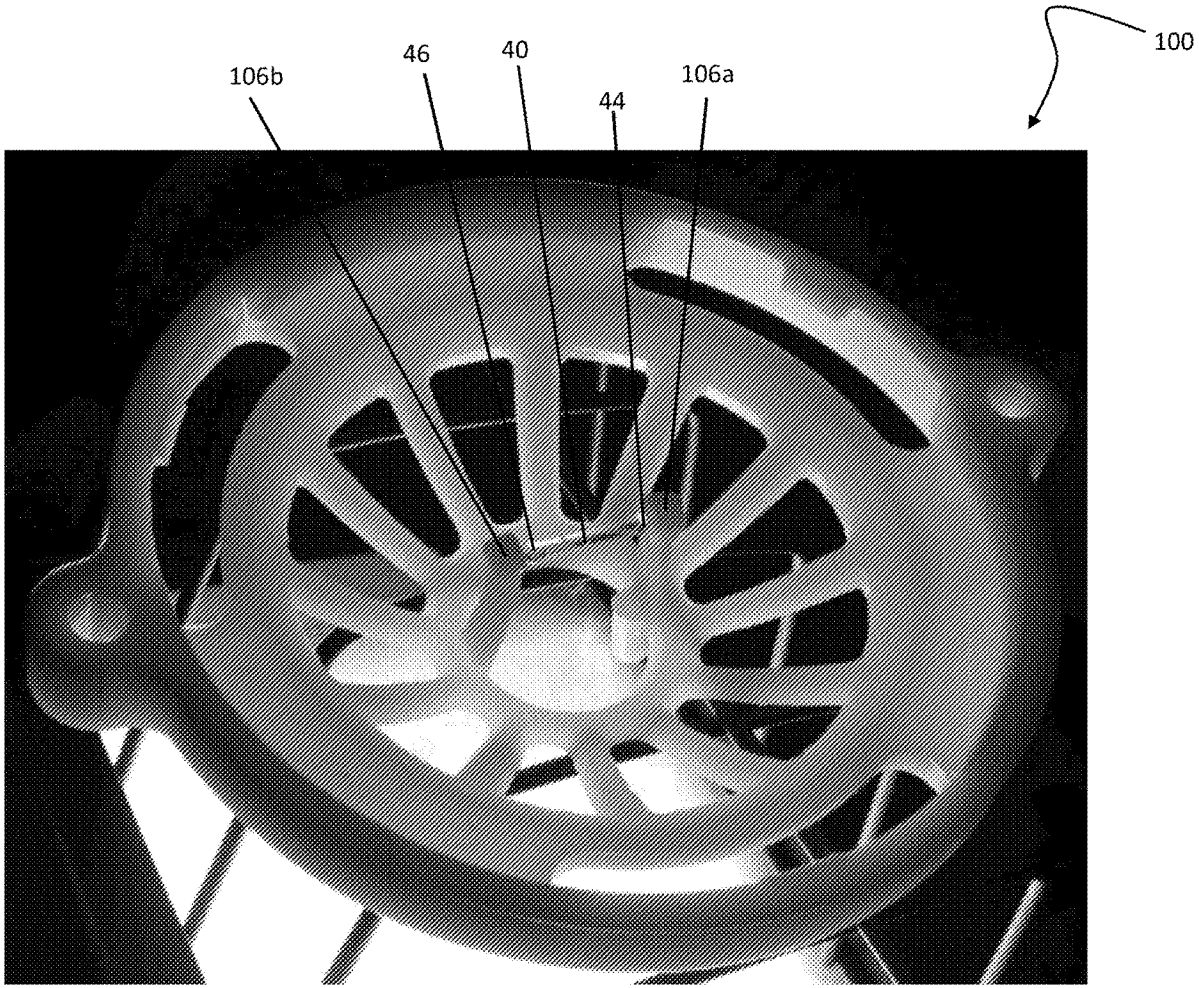
FIG. 4 is a perspective view of an exemplary portion of a fire suppression sprinkler assembly.
Figure 10:
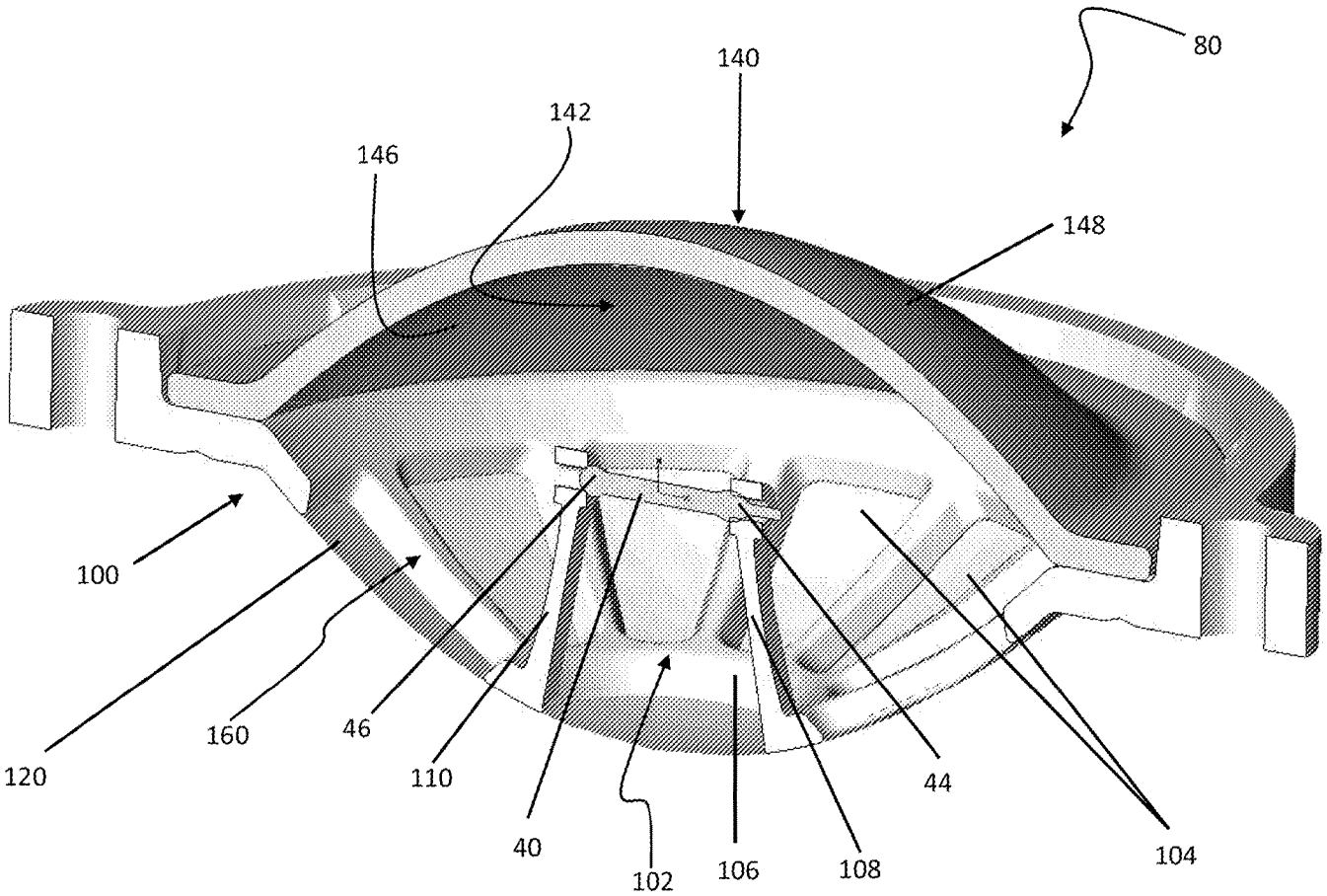
FIG. 10 is a perspective view of another fire suppression sprinkler assembly according to an embodiment of the invention.

The fire suppression sprinkler 20 may be mounted to a portion of a building, ship, or other structure, such as to a ceiling for example. Referring now to FIGS. 2 through 7, exemplary fire suppression sprinkler assemblies 10 also include a cover plate 100 mounted adjacent the first end 21 of a sprinkler 20. A top surface 102 of the cover plate 100 connects to an adjacent mounting surface 80 using fasteners, adhesive, or other known connection means. The mounting surface 80 may be a ceiling, or alternatively, may be a portion of a trim can for example. The cover plate 100 is generally concave, such that the first end 21 of the sprinkler 20, including the activator bulb 40, is disposed within a cavity 104 of the cover plate 100 below the plane of mounting surface 80. In one embodiment, the cover plate 100 includes at least one arm 106 for supporting an end of the activator bulb 40. As illustrated in FIG. 4, the cover plate 100 may include a first arm 106*a* configured to support a first end 44 of the activator bulb 40 and a second arm 106*b* configured to engage the second opposite end 46 of the bulb 40. A separate cover layer 120 may be disposed about the exterior of the cover plate 100 (FIGS. 3 and 10). In one embodiment, the cover layer 120 is made from a lightweight metallic material, such as a foil for example. The exterior surface of either the cover plate 100 or the cover layer 120 may be painted the same color as the mounting surface 80 so that the fire suppression sprinkler assembly 10 is integrally formed with its surroundings in an aesthetically pleasing manner such that no apparent shadow line exists.

Figure 5:
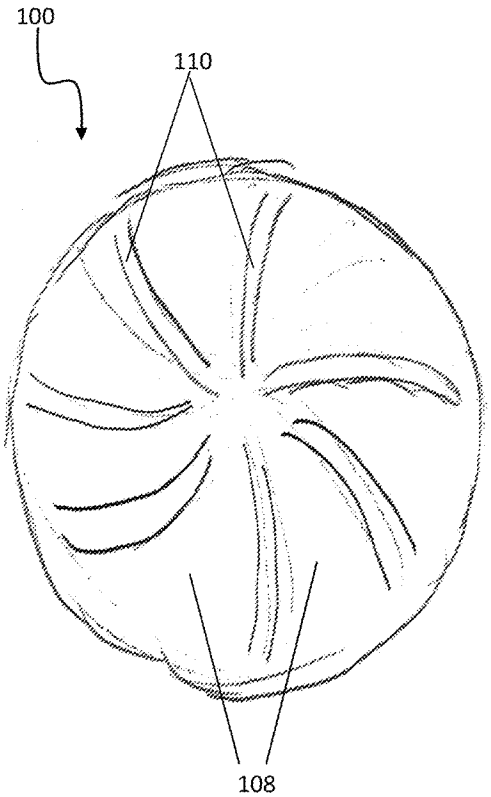
FIG. 5 is a top view of a cover plate of a fire suppression sprinkler assembly according to an embodiment of the invention.

The cover plate 100 may be manufactured from plastic or another durable material. In one non-limiting embodiment, the cover plate 100 is formed from a thermally and/or visually semi-transparent material. The cover plate 100 includes a plurality of openings 108 that allow heat to transfer into the cavity 104 toward the activator bulb 40 or allow a fire suppression fluid to be discharged outside of the cavity 104. For example, holes or slots 108 may cover in the range of about 25 percent to about 75 percent of the surface area of the cover plate 100. In one embodiment, the plurality of openings 108 may be arranged generally perpendicular to the airflow adjacent surface 80, to increase the activation time of the sprinkler 20. The cover plate 100 may additionally include a plurality of heat features 110 configured to channel heat towards the activator bulb 40 positioned at the center of the cavity 104. The heat features 110, such as ribs for example, protrude inwardly or outwardly from a surface of the cover plate 100 and may have a substantially constant thickness or a variable thickness along the length of each heat feature 110. The plurality of heat features 110 may be identical or may be dissimilar. As illustrated in FIG. 5, the heat features 110 may curve generally radially outwardly from the center of the cover plate 100 or alternatively may be straight.

Figure 6:
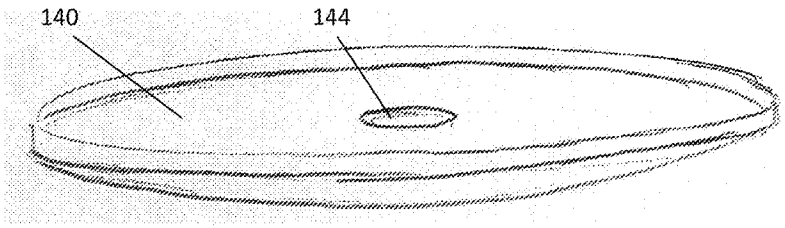
FIG. 6 is a perspective view of a cover plate and top plate of a fire suppression sprinkler assembly according to an embodiment of the invention.
Figure 7:
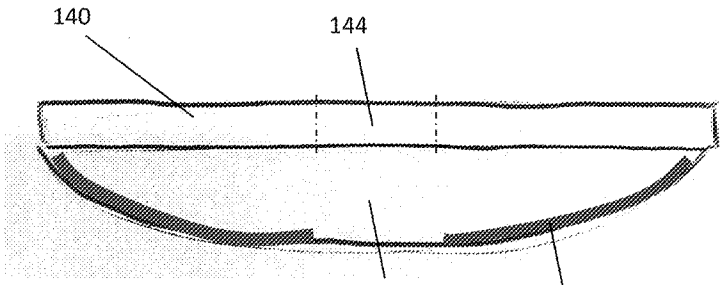
FIG. 7 is a cross-section of the cover plate and top plate illustrated in FIG. 6.
Figure 8:
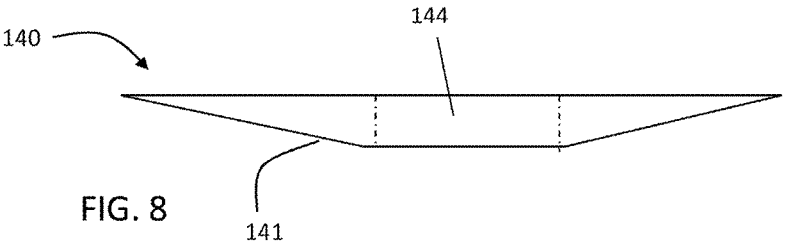
FIG. 8 is a cross-section of a top plate according to an embodiment of the invention.

Referring now to FIGS. 6-8, a top plate 140 including a central opening 144 through which a first end 21 of the sprinkler 20 is received may be used in conjunction with the cover plate 100. A portion of the top plate 140 has a diameter substantially equal to the diameter of the cavity 104 adjacent the top surface 102 of the cover plate 100. In one embodiment, the top plate 140 is mounted to a surface opposite the cover plate 100 (see FIG. 9). In another embodiment, the top plate 140 is supported by a portion of the cover plate 100, such as through a snap-fit connection for example (see FIG. 10). The top plate 140 traps heat within the cavity 104 adjacent the activator bulb 40. In one embodiment, the top plate 140 may be a generally flat disc having a uniform thickness, as shown in FIG. 7, or alternatively may include a partially angled bottom surface 141 that facilitates the flow of hot air toward the activator bulb 40 (FIG. 8). The top plate 140 may be formed separately from the cover plate 100 or may be integrally formed with the cover plate 100, such as through an injection molding process for example.

When a fire is present, and the cover plate 100 does not include a cover layer 120, the heat and combustion gasses generated by the flames enter into the cavity 104 through the plurality of openings 108 in the cover plate 100. Inclusion of the top plate 140 prevents the heat and gasses from rising away from the first end 21 of the sprinkler 20. The semi-transparent cover plate 100 is heated through convection from the rising heat and gas. In turn, heat from the cover plate 100 radiates to the air within the cavity 104. In embodiments where the cover plate 100 includes a plurality of heat features 110, the heat features 110 will channel the heat and gas flowing into the cavity 104 directly toward the activator bulb 40.

Figure 9:
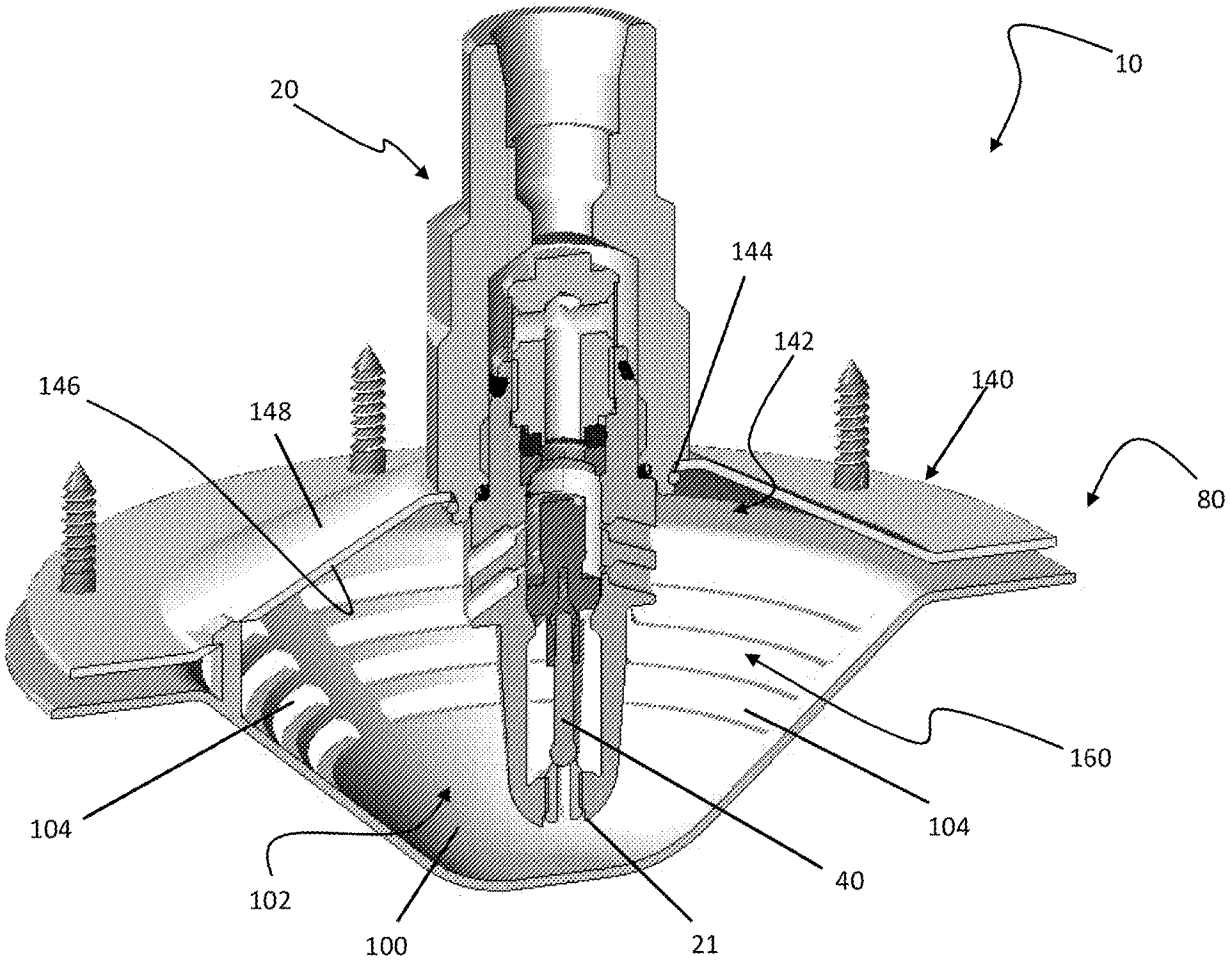
FIG. 9 is a perspective view of a fire suppression sprinkler assembly according to an embodiment of the invention.

In another embodiment, illustrated in FIGS. 9 and 10, the top plate 140 of the fire suppression sprinkler assembly 10 is generally convex and defines a cavity 142 such that the first end 21 of the sprinkler 20 may be disposed therein. The cavity 142 of the top plate 140 adjoins the cavity 102 of the cover plate 100 to create a larger cavity 160 within which the entire first end 21 of the sprinkler 20 is located. In the illustrated embodiment, the interior surface 146 of the top plate 140 is reflective to redirect heat within the cavity 142. In one embodiment, the interior surface 146 is made from a foil, such as aluminum foil for example. The top plate 140 may also include a plastic, exterior shell 148 such that the foil forms a lining on the interior of the shell 148. The plastic shell 148 retains the mirror-like interior surface 146 in a desired shape. In one embodiment, the top plate 140 is generally parabolic in shape and has a height such that the activator bulb 40 of the sprinkler 20 is located at the focus of the top plate 140.

When a fire is present and the cover plate 100 includes a cover layer 120, the heat and combustion gasses generated by the flames will heat the cover layer 120. As the temperature of the cover layer 120 increases, heat is released into the cavity 160 via infrared radiation. By including multiple openings 108 in the cover plate 100, the area of the cover layer 120 that transfers heat to the cavity 160 may be maximized. Because the cover layer 120 is thin and has a large surface area, the temperature of the cover layer 120 rapidly increases such that the temperature of the cover layer 120 closely follows the temperature of the combustion gasses. When a parabolic top plate 140 having a reflective interior surface 146 is positioned opposite the cover plate 100, the heat within the cavity 160 radiates to the mirror-like interior surface 146. Because of the parabolic shape of the top plate 140 and the positioning of the activator bulb 40 within the cavity 160, heat energy reflects from the interior surface 146 and is directed to the activator bulb 40 positioned at the focus of the top plate 140. In this manner, the top plate 140 acts as a reflector, concentrating the radiated heat from the fire toward the activator bulb 40, to accelerate the activation of the sprinkler 20. The top plate 140 and the cover layer 120 act as an amplifier, making it possible to increase the temperature of the activator bulb 40 without heating the air within the cavity 160 to a temperature at least equal to the bulb activation temperature.

Once activated, the pressure of the fire suppression fluid may break through the cover layer 120 adjacent the openings 104 in the cover plate 100. Alternatively, at least a portion of the sprinkler 20 may move relative to the ceiling. In one embodiment, the sprinkler 20 applies a force to the cover plate 100 such that the first end 21 of the sprinkler 20 is exposed. For example, the In an alternate embodiment, the first end 21 of the sprinkler may penetrate through the central hole of the cover plate 100 and through the cover layer 120 such that cover layer does not block the emission of fire suppression fluid.

By locating the cover plate 100 and top plate 140 adjacent the first end 21 of the sprinkler 20, the heat generated by a fire is focused directly at the activator bulb 40. By concentrating heat energy at the bulb 40, the time required for the fluid inside the bulb 40 to expand and break the bulb 40 is minimized. Consequently, the sprinklers are activated more quickly in the presence of a fire, allowing the fire to be suppressed or extinguished more rapidly. Use of a cover plate 100 and top plate 140 to hasten the activation of a sprinkler 20 is not limited to water mist applications, and may be used on any type of sprinkler 20 actuated by an activator bulb 40. In addition, because direct contact with the heat and combustion gasses is not required to activate the sprinkler 20 when a top plate 140 having a reflective interior surface 146 is used, in some instances the sprinkler assembly 10 may be mounted in a manner such that no gaps exist between the cover plate 100 and the mounting surface. This mounting method prevents dust and other particles from building up on the activator bulb 40, reducing the maintenance of the sprinkler assembly 10.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A fire suppression sprinkler assembly coupled to a mounting surface, comprising:

a sprinkler including a heat responsive element arranged adjacent a first end;

a cover plate positioned adjacent the mounting surface such that the heat responsive element is disposed within a cavity formed between the cover plate and the mounting surface, the cover plate including a thermally conductive cover layer; and a top plate having a reflective interior surface and being positioned substantially opposite the cover plate adjacent the first end of the sprinkler, the top plate is configured to reflect heat towards the heat responsive element.

2. The fire suppression sprinkler assembly according to claim 1, wherein the sprinkler includes a horizontal heat responsive element.

3. The fire suppression sprinkler assembly according to claim 1, wherein the sprinkler includes a vertical heat responsive element.

4. The fire suppression sprinkler assembly according to claim 1, wherein the sprinkler is movable relative to the cover plate.

5. The fire suppression sprinkler assembly according to claim 1, wherein the cover plate is connected to a first side of the mounting surface and the top plate is mounted to a second, opposite side of the mounting surface.

6. The fire suppression sprinkler assembly according to claim 1, wherein the cover plate is connected to the mounting surface and the top plate is connected to the sprinkler.

7. The fire suppression sprinkler assembly according to claim 1, wherein the thermally conductive cover layer is made from a foil.

8. The fire suppression sprinkler assembly according to claim 7, wherein an exterior surface of the cover layer matches a color of the mounting surface.

9. The fire suppression sprinkler assembly according to claim 1, wherein the reflective interior surface of the top plate is made from a foil.

10. The fire suppression sprinkler assembly according to claim 1, wherein the top plate is generally parabolic in shape.

11. The fire suppression sprinkler assembly according to claim 10, wherein the heat responsive element is arranged at a focus of the top plate.

12. The fire suppression sprinkler assembly according to claim 1, wherein the cover plate includes at least one arm that engages an end of the activator bulb.

13. A method of activating a fire suppression sprinkler comprising:

heating a cover layer coupled to a cover plate, the cover plate being connected to a mounting surface such that a heat responsive element of the sprinkler is disposed within a cavity formed between the cover plate and the mounting surface;

transmitting the heat from the cover layer to a top plate opposite the cover plate;

reflecting the heat off the top plate toward the heat responsive element such that the heat responsive element activates the sprinkler.

14. The method of activating a fire suppression sprinkler according to claim 13, wherein the heat radiates from the cover layer to the top plate.

15. The method of activating a fire suppression sprinkler according to claim 13, wherein the heat reflects off of an interior mirror-like surface of the top plate.

16. The method of activating a fire suppression sprinkler according to claim 13, wherein the top plate is generally parabolic in shape.

17. The method of activating a fire suppression sprinkler according to claim 16, wherein the heat responsive element is positioned at the focus of the top plate.

18. A fire suppression sprinkler assembly coupled to a mounting surface, comprising:

a sprinkler including a heat responsive element arranged adjacent a first end; and a cover plate positioned adjacent the heat responsive element, the cover plate including a plurality of holes through which heat and gas reach the heat responsive element such that the cover plate is thermally semi-transparent; and a plurality of heat features extending from a surface of the cover plate, the plurality of heat features being configured to channel heat towards the heat responsive element.

19. The fire suppression sprinkler assembly according to claim 18, further comprising a top plate having a central hole through which the first end of the sprinkler is received, the top plate being positioned substantially opposite the cover plate adjacent the first end of the sprinkler to substantially enclose the heat responsive element within the cavity.

20. The fire suppression sprinkler assembly according to claim 18, wherein the sprinkler includes a horizontal heat responsive element.

21. The fire suppression sprinkler assembly according to claim 18, wherein the sprinkler includes a vertical heat responsive element.

22. The fire suppression sprinkler assembly according to claim 18, wherein the sprinkler is movable relative to the cover plate.

23. The fire suppression sprinkler assembly according to claim 19, wherein the cover plate is connected to a first side of the mounting surface and the top plate contacts a feature of the cover plate.

24. The fire suppression sprinkler assembly according to claim 18, wherein an exterior surface of the cover plate matches a color of the mounting surface.

25. The fire suppression sprinkler assembly according to claim 19, wherein the top plate is a disc having a substantially constant thickness.

26. The fire suppression sprinkler assembly according to claim 19, wherein a bottom surface of the top plate is angled to direct heat towards the heat responsive element.

27. The fire suppression sprinkler assembly according to claim 18, wherein the cover plate includes a plurality of heat features configured to channel heat within the cavity towards the heat responsive element.

28. The fire suppression sprinkler assembly according to claim 27, wherein the plurality of heat features are ribs.

29. The fire suppression sprinkler assembly according to claim 27, wherein the plurality of heat features curve generally radially outward from the heat responsive element.

30. A method of activating a fire suppression sprinkler comprising:

heating a thermally semi-transparent cover plate;

transmitting the heat from the cover plate to the air formed within a cavity of the cover plate; and channeling the heated air within the cavity to a heat responsive element located at a first end of the sprinkler via a plurality of heat features extending from a surface of the cover plate such that the heat responsive element activates the sprinkler.

31. The method according to claim 30, wherein the heat transfers to the cover plate from the surrounding heat and gasses through convection.

32. The method according to claim 30, wherein the heat radiates from the cover plate to the air within the cavity.

33. The method according to claim 30, wherein the cover plate includes a plurality of openings through which heat and gas pass into the cavity.

34. The method according to claim 30, wherein the cover plate includes a plurality of heat features configured to direct the heated air towards the heat responsive element.

35. A fire suppression sprinkler assembly coupled to a mounting surface, comprising:

a sprinkler including a heat responsive element positioned adjacent a first end;

a cover plate including a plurality of openings positioned adjacent the heat responsive element such that the cover plate surrounds a portion of the heat responsive element; and a top plate positioned substantially opposite the cover plate adjacent the heat responsive element to substantially enclose the heat responsive element, wherein the top plate is shaped to facilitate a flow of hot air towards the heat responsive element.

* * * * *